US005314231A

United States Patent [19]

Otterbacher

[11] Patent Number: 5,314,231

[45] Date of Patent: May 24, 1994

[54] FOLDING PICNIC TABLE

[76] Inventor: Gary Otterbacher, c/o Otterbacher Manufacturing, Inc. P.O. Box 396 U.S. Hwy. 30 N., Crestline, Ohio 44827

[21] Appl. No.: 951,467

[22] Filed: Sep. 25, 1992

[51] Int. Cl.[5] ..... A47B 3/06

[52] U.S. Cl. ..... 297/159; 297/157; 108/131

[58] Field of Search ..... 297/157, 159; 108/112-114, 131

[56] References Cited

U.S. PATENT DOCUMENTS

| | | | |
|---|---|---|---|
| 2,512,473 | 6/1950 | Alch | 297/159 |
| 2,690,210 | 6/1954 | Holick | 297/159 |
| 2,939,516 | 6/1960 | Drew | 297/159 |
| 3,273,936 | 9/1966 | Deavers | 297/159 |
| 4,047,754 | 9/1977 | Cathey | 297/157 |
| 4,415,199 | 11/1983 | Wright | 297/159 |

*Primary Examiner*—Michael F. Trettel
*Attorney, Agent, or Firm*—Biebel & French

[57] ABSTRACT

A folding picnic table is provided having a pair of spaced end frames, a table top frame, two pairs of cooperating folding braces, and a pair of bench frames. The cooperating braces each have a first and second brace portion with the first brace portion connected to an end frame. The second brace portion is connected to the table top frame, and the first and second brace portions are connected to each other. Each bench frame comprises at least two slotted bars with the end frames also being pivotally connected to the slotted bars.

18 Claims, 6 Drawing Sheets

FOLDING PICNIC TABLE

BACKGROUND OF THE INVENTION

The present invention relates generally to a picnic table, and more particularly, to a folding picnic table.

Picnic tables have proven very popular since they enable several individuals to be seated at a table for purposes of eating. Traditionally, picnic tables have been found in backyards and parks. More recently, picnic tables have enjoyed increasing popularity at fairs and other community events where a large attendance is anticipated, since a typical picnic table can seat at least 6, and often 8, individuals.

Unfortunately, the storage of picnic tables when not in use can present a problem. Oftentimes, picnic tables are left in place throughout the year, due to their bulkiness. This forces them to be subjected to the elements, which in colder or wetter climates can shorten the lifespan of the picnic table.

Similarly, fairs or other short-term community events may find it desirable to place the picnic tables in storage when not in use. This typically is done by stacking one table upside down on top of another. The drawback of the aforementioned method of storage are that the tables still require a significant amount of storage space, and they may fall causing injury to children who climb on them. Therefore, it would be desirable to have a folding picnic table.

Folding tables of various configurations are well known in the art. However, relatively few folding picnic tables are known to exist. One such folding picnic table is disclosed in U.S. Pat. No. 4,415,199. That particular table comprises two parallel end frames having a pedestal formed in two hinged sections which sections fold inwardly toward each other as well as being adapted to assume an extended position with the two hinged sections of each pedestal being in end-to-end relationship. A pair of unitary rod-like braces have corresponding ends permanently, and pivotally attached to an end frame and have opposite corresponding ends adapted for releasable attachment to the pedestals when the hinged sections of the pedestals are extended. Releasable locking pins for the opposite corresponding ends of the braces when they are engaged with the extended pedestals are provided for locking the picnic table in an extended use position. Each locking pin passes through locking openings in its respective brace and pedestal. When the locking pins are not positioned so as to lock the brace to the pedestal, the locking pin is connected to the picnic table by a flexible tether element. When folded, the table of U.S. Pat. No. 4,415,199 also has the two braces suspended from the table by separate tethers. However, it can be appreciated from reading the patent that once the table is folded, there is nothing disclosed to prevent the table from unfolding during transport of the table to a predetermined place of storage.

It is thus apparent that the need exists for an improved folding picnic table which can be locked into a storage position, and which is less cumbersome than other known folding picnic tables.

SUMMARY OF THE INVENTION

The problems associated with the prior folding picnic tables are overcome in accordance with the present invention by providing a folding picnic table having a pair of spaced end frames, a table top frame, two pairs of cooperating folding braces, and a pair of bench frames. Each pair of spaced end frames has a center pedestal and a pair of upright bars, with each bar of upright bars being connected to the respective center pedestal by a base cross bar. The table top frame comprises a fixed cross panel and a plurality of fixed cross bars, with each of the center pedestals being connected to the table top frame. Each pair of cooperating folding braces comprises a first brace portion and a second brace portion. Each first brace portion is connected to an end frame. Each second brace portion is connected to the table top frame. The first brace portion and the second brace portion are also connected to each other with the first brace portion and the second brace portion being in partially coextensive relationship. Finally, each bench frame comprises at least two slotted bars having a slot formed therethrough, with the upright bars being connected to the slotted bars. Additionally, each of the slots formed in the slotted bars is preferably disposed in a horizontal plane parallel to the bench frames.

The second brace portions are preferably pivotally connected to the fixed cross panel. The upright bars each comprise a seat support with each of the seat support being adapted to pivotally engage with at least one slotted bar. The seat supports and the slotted bars are maintained in mechanical engagement by slot studs. The first brace portion and the second brace portion are connected by two fasteners, with the second fastener being adapted to be removed from connecting the first and second brace portions such that the removal enables the respective end frame to be pivoted relative to the table top frame so as to effect folding of the table.

The table top frame comprises at least one locking bracket, while the end frame comprises at least one locking tab. The locking bracket and the locking tab are adapted to be positioned in cooperating relationship. The second fastener, after removal from connecting the first and second brace portions, is adapted to secure a locking bracket to a locking tab. Each end frame has secured thereto a handle. Preferably the handle is secured to the center pedestal. Preferably the center pedestal is hinged directly to the table top frame.

The upright bars each comprise a seat support. Each of these seat supports comprises a pair of seat support arms. Each seat support arm is adapted to pivotally engage with a slotted bar. The table also includes a table top cover and a pair of bench covers.

There is also disclosed a folding picnic table comprising a pair of spaced end frames, a table top frame, two pairs of cooperating folding braces, and a pair of bench frames with the spaced end frames each having a handle, a center pedestal, and a pair of upright bars. Each pair of upright bars is connected to a respective center pedestal by a base cross bar. The table top frame comprises a fixed cross panel and a plurality of fixed cross bars. Each of the center pedestals are connected to the table top frame. The table top frame comprises at least one locking bracket, while at least one end frame comprises at least one locking tab.

With respect to the two pairs of cooperating folding braces, each pair of braces comprises a first brace portion and a second brace portion. While the first brace portion is connected to the end frame, the second brace portion is pivotally connected to the fixed cross panel. The first brace portion and the second brace portion are also connected to each other, as well as being in partially coextensive relationship to one another. With respect to the pair of bench frames, each bench frame comprises at least two slotted bars having a slot formed therethrough. The upright bars each comprise a seat support with each of these seat supports comprising a pair of seat support arms. Each seat support arm is adapted to pivotally engage with a slotted bar. The slots are disposed in a horizontal plane parallel to the bench frames. The seat supports and the slotted bars are maintained in mechanical engagement by slot studs. Additionally, the first brace portion and the second brace portion are connected by two fasteners. With the second fastener being adapted to be removed from connecting the first and second brace portions, such that the removal enables the respective end frame to be pivoted relative to the table top frame so as to effect folding of the table.

The locking bracket and locking tab are adapted to be positioned in cooperating relationship, such that the second fastener after removal from connecting the first and second brace portions is adapted to secure a locking bracket to a locking tab. Furthermore, the center pedestal is preferably hinged directly to the table top frame. Still further, the table includes a table top cover and a pair of bench covers.

There is also disclosed a folding picnic table comprising a pair of spaced end frames, a table top frame, two pairs of cooperating folding braces and a pair of bench frames with each of the pairs of braces comprising a first brace portion having a first and a second end and a second brace portion having a first and a second end with means for connecting the first brace portion to the end frame, means for connecting the second brace portion to the table top frame, and means for connecting the first brace portion and the second brace portion to each other. Each end frame comprises a center pedestal and a pair of upright bars with the pair of upright bars connected to the respective center pedestal by a base cross bar. Each of the center pedestals are connected to the table top frame with the table top frame having a table top cover secured thereto. Each of the upright bars also has means for pivotally connecting the end frames to the bench frames, and each of the bench frames has a seat cover secured thereto.

The upright bars each comprise a seat support. Each of the seat supports comprise a pair of seat support arms. Each of the bench frames comprise two pairs of slotted bars. Each of the slotted bars having a slot formed therethrough. The slots are disposed in a horizontal plane parallel to the bench frames. Each seat support is adapted to pivot and slide within the slots. The first brace portion and the second brace portion are connected by a first and second fastener. The second fastener is adapted to be removed from connecting the first and second brace portions such that the removal enables the respective end frame to be pivoted relative to the table top frame comprises effect folding of the table. The table top frame comprises at least one locking bracket. The end frame comprises a handle and at least one locking tab. The locking bracket and the locking tab are adapted to be positioned in cooperating relationship such that the second fastener after removal from connecting the first and second brace portions is adapted to secure a locking bracket to a locking tab.

It is the primary object of the present invention to provide a folding picnic table which is conveniently folded, yet which is sturdily built, as well as being aesthetically pleasing.

Still another object of the present invention is to provide a folding picnic table having an improved structure which is less costly to construct.

Other objects and advantages of the present invention will be apparent from the following description, the accompanying drawings, and the appended claims.

DETAILED DESCRIPTION OF THE INVENTION

Figure 1:
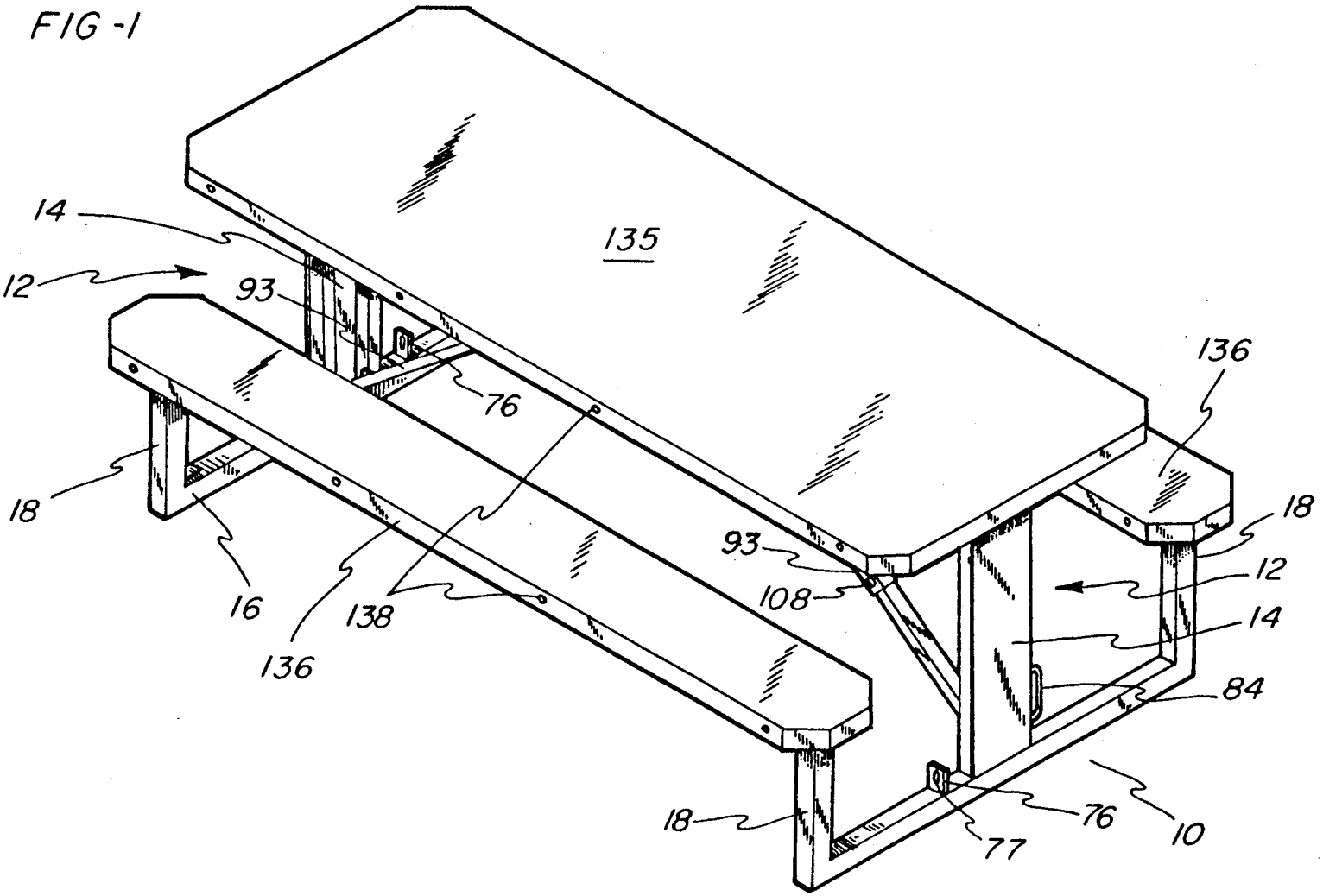
FIG. 1 is a perspective view of a folding picnic table made in accordance with the present invention.

Having reference to the drawings, attention is directed first to FIG. 1 which discloses a perspective view of a folding picnic table made in accordance with the present invention and designated generally by the numeral 10. The picnic table as can be appreciated from a comparison of FIGS. 1 and 2 has two end frames 12 which are spaced apart from and are parallel to one another. Each of the end frames 12 has a center pedestal 14. Extending sidewardly from the center pedestal 14 is a base cross bar, preferably square in cross section and having an upper surface 17. At the opposite ends of the base cross bar are a pair of upright bars 18. Thus, it may be appreciated that four upright bars are provided for use in the folding table of this invention. The upright bar 18 is also preferably of the same square cross section as the base cross bar 16.

Although not visible in FIGS. 1 and 2, FIGS. 3, 5, 6, and 7 disclose the presence at the top of each of the upright bars 18 of a seat support 20. This seat support 20 preferably is formed from a generally U-shaped plate of metal. This generally U-shaped seat support 20 is formed having a seat support center portion 22 and a pair of seat support arms 24, with all the seat support arms 24 having formed therein a seat support aperture 26. The upright bar 18 is preferably welded to the seat support center portion 22 at its midpoint, with the pair of seat supports 20 associated with the same seat having their arms 24 face one another.

Figure 3:
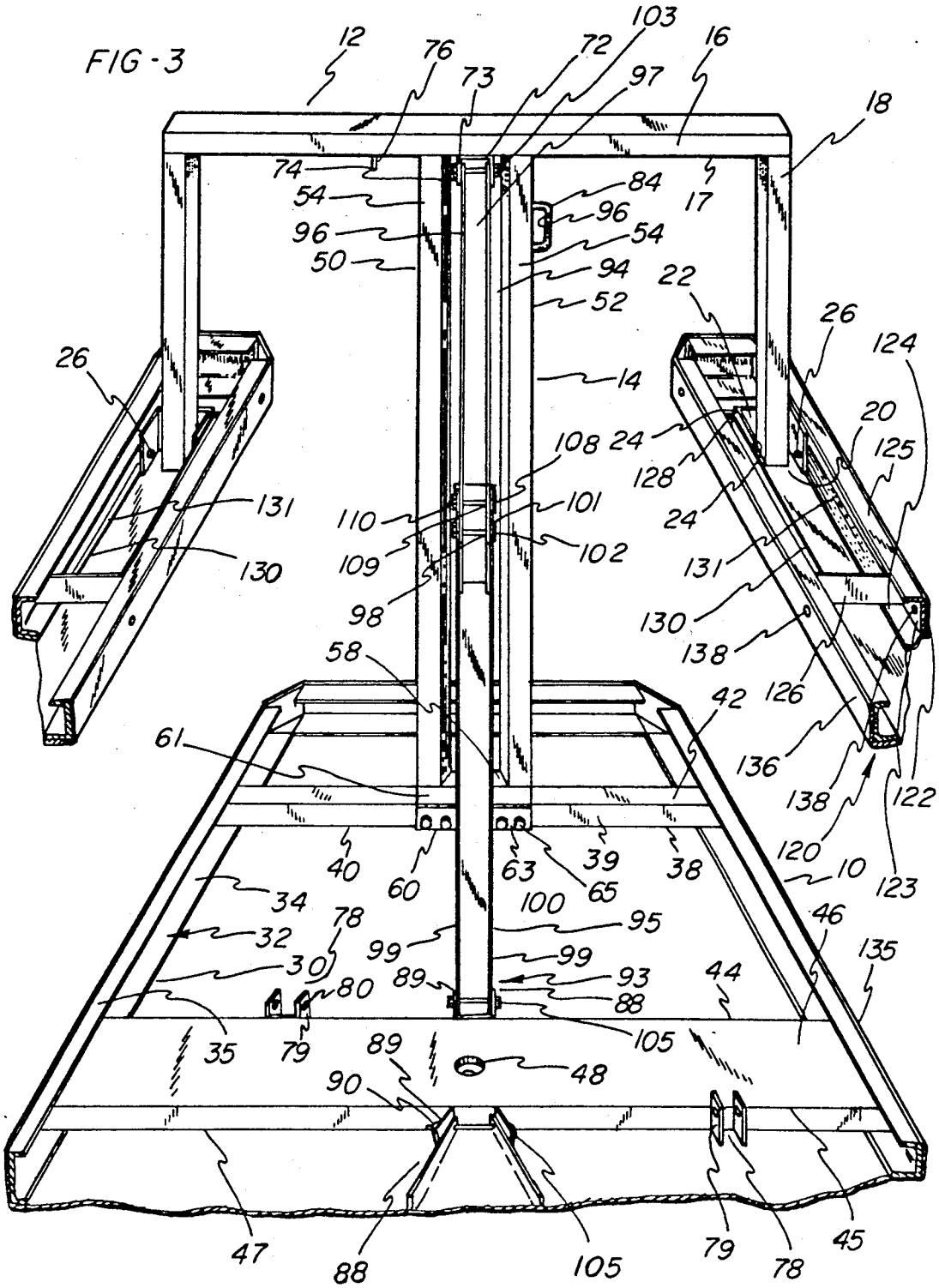
FIG. 3 is a partial perspective view of the underside of the folding picnic table made in accordance with the present invention.

As can best be appreciated from FIG. 3, the table top 30 comprises an edge channel 32 having sidewall 33, top lip 34, and bottom lip 35, with the bottom and top lip extending inwardly and perpendicularly with respect to the sidewall 33. Additionally, the width of the top lip is preferably greater than that associated with that of the bottom lip. It will be appreciated that at the end of each end of the table top frame and bench frame, are beveled portions of each of the frames which do not have either a bottom or a top lip. Furthermore, the actual end pieces of both the table top frame and bench frame do not have a bottom lip. It will be appreciated that the table top frame 30 also has a pair of fixed cross bars of C-shaped cross section positioned near the opposite ends of the table top frame 30. Each of these fixed cross bars 38 has a sidewall 39, a top surface 40, and a bottom surface 42. The top and bottom surface are parallel to each other and are perpendicular with respect to the sidewall 39. The fixed cross bar has its top surface 40 and bottom surface 42 extending from sidewall 39 towards the end of the table top frame 30.

Located preferably at the midpoint of the table top frame is a fixed cross panel 44 having a bottom 46, top 47, and cross panel aperture 48 which extends through both the bottom and top surfaces 46 and 47, respectively of fixed cross panel 44. This fixed cross panel 44 extends between opposite sides of the table top frame 30.

The center pedestal 14 is formed having a first center pedestal sidewall 50, a second center pedestal sidewall 52, a pair of inwardly facing flanges 54, an outer surface 56, and an end panel 58. The first and second center pedestal sidewalls, 50 and 52 respectively, extend inwardly towards the fixed cross panel 44 from the outer panel 56. The pair of inwardly facing flanges are preferably parallel to the outer panel 56 and extend towards each other perpendicularly from the first and second center pedestal sidewalls. End panel 58 preferably is formed having two plates perpendicular to one another. The first plate of the end panel 58 is also perpendicular to the first and second center pedestal sidewalls and parallel to the upper surface 17 of the base cross bar 16. Furthermore, the end panel 58 preferably has a second plate which is parallel to the inwardly facing flanges 54 and preferably is also secured thereto.

A pair of hinges 60 are provided having a hinge first portion 61 and a hinge second portion 63. The hinge appropriate means to the end panel 58 of the center pedestal 14. The hinge second portion 63 is preferably secured to the sidewall 39 of the fixed cross bar 38 by hinge bolts 65 which pass through apertures in the hinge second portion 63. The placement of the hinge is made such that the end frame 12 can be folded down upon the table top frame 30 as will be described below.

Having reference to the drawings, a comparison of FIGS. 1 and 3 will disclose that a base bracket 72 is preferably welded to that portion of the upper surface 17 of base cross bar 16 which is between the first and second center pedestal sidewalls 50 and 52 respectively. More preferably base bracket 72 is formed having a pair of upwardly projecting arms 73 having apertures 74 formed therein, with the base bracket itself preferably being welded to the upper surface of the base cross bar equidistant from opposing first and second center pedestal sidewalls.

Each end frame 12 features a single locking tab 76 formed from a metal plate and oriented perpendicularly to the upper surface 17 and preferably parallel to the center pedestal sidewalls. This locking tab 76 has an aperture 77 formed therein. At least one locking bracket 78 is formed and secured to the fixed cross panel 44. Preferably the locking bracket is of a generally C-shaped configuration with a pair of arms 79 depending downwardly from the bottom 46 of the fixed cross panel 44 when the table is in its erected position as viewed in FIGS. 1 and 5. The locking bracket arm 79 each have formed therein an aperture 80. Preferably the locking tab and locking bracket are positioned such that upon the folding of the table the apertures 77 and 80 become aligned and the locking tab 76 and the arms 79 of the locking bracket are spaced a short distance apart from each other as shown.

Figure 2:
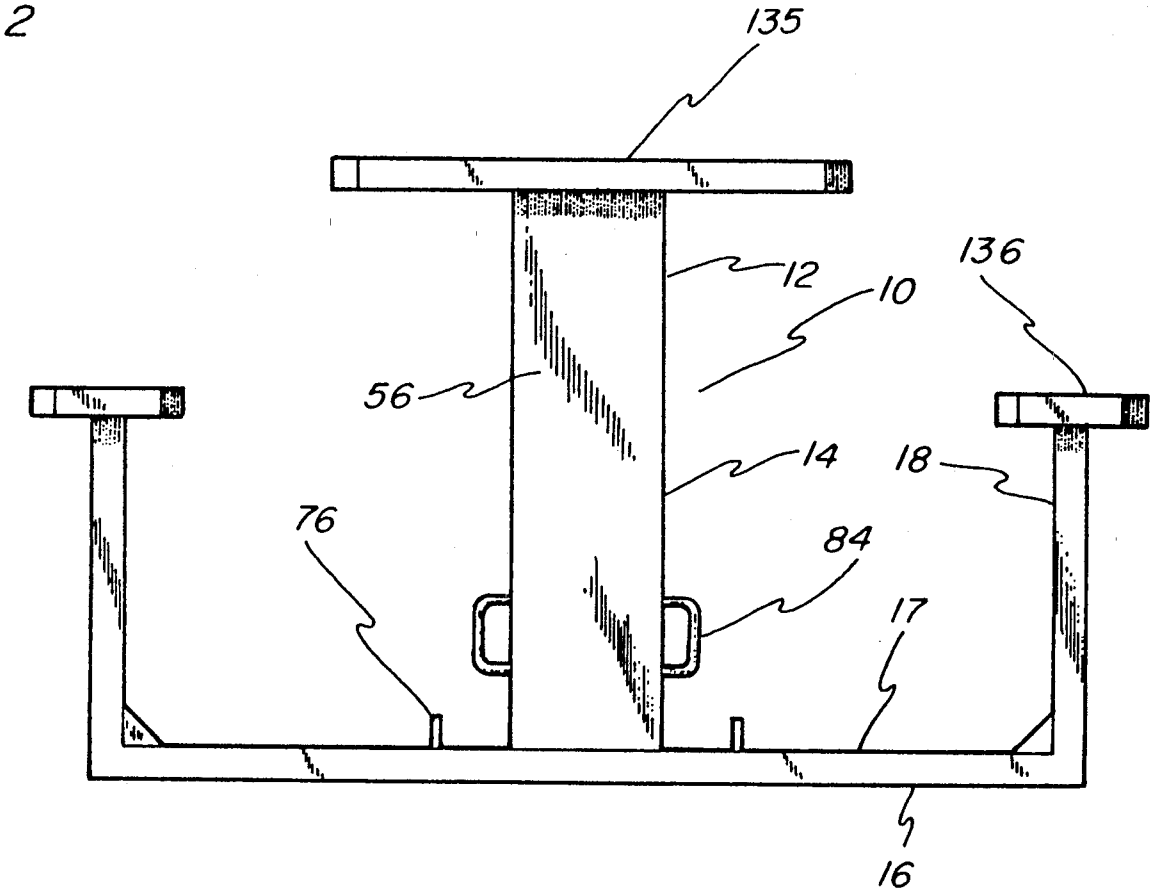
FIG. 2 is an end elevational view of the picnic table shown in FIG. 1.

A comparison of FIGS. 2 and 3 reveal that a pair of handles 84 are provided on opposite ends of the picnic table 10. It thus can be appreciated that in FIG. 2 the numbered handle and locking tab are at the near end of the picnic table while the unnumbered handle and locking tab are associated with the end frame 12 at the far end of the table. Preferably the handle 14 is secured to the second center pedestal sidewall 52 of the center pedestal. The handle extends sidewardly from the center pedestal toward the upright bar 18 adjacent thereto. Preferably the handle extends parallel to the base cross bar 16.

A pair of upper brackets 88 are secured to the opposing outer sidewalls of the fixed cross panel 44. These upper brackets 88 include arms 89 which project perpendicularly from the fixed cross panel sidewalls, with each of these arms having formed therein aperture 90. The folding picnic table 10 of this invention also includes two pairs of folding braces 93. These cooperating folding braces 93 are preferably formed as C-shaped channels having a first brace portion 94 and a second brace portion 95. Both the first brace portion and second brace portion have first and second ends. The first brace portion 94 also has first brace portion sidewalls 96 having formed therein a base connecting aperture 97 and a brace connecting aperture 98. The base connecting aperture is formed near the one end of the first brace portion, while the brace connecting aperture 98 is formed near the opposing end. Similarly, the second brace portion is formed having second brace portion sidewalls 99, an upper connecting aperture 100 and a brace connecting aperture 101. The second brace portion has its upper connecting aperture formed so as to be able to be connected to the upper brackets 88. The first brace portion 94 is secured through the base connecting aperture 97 to base bracket 72 by means of bottom bolt 103. The first and second brace portions are secured to one another through respective brace connecting apertures 98 and 101 by brace bolt 102. Finally, upper bolts 105 serve to connect the upper brackets 88 to the second brace portion 95 at the upper connecting apertures 90 and 100.

Figure 4:
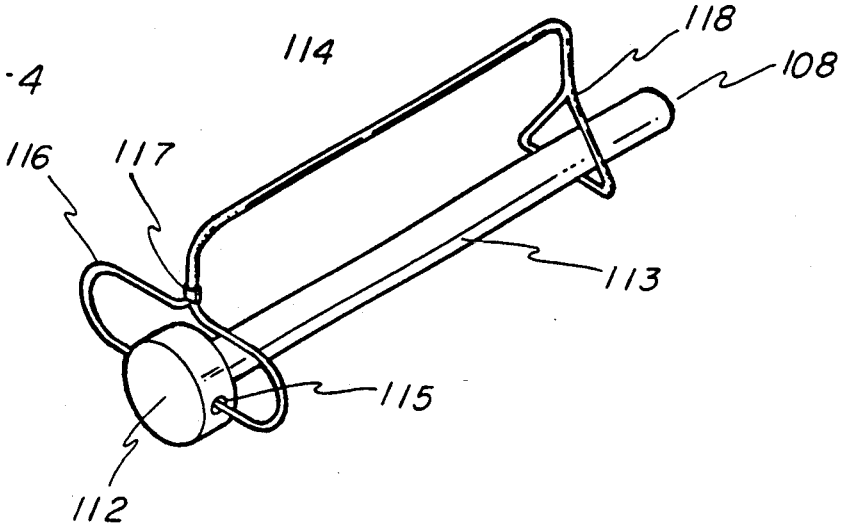
FIG. 4 is a perspective view of the locking pin used in the present invention.

A locking pin 108 passes through first brace portion locking pin apertures 109 and second brace portion locking pin apertures 110 so as to further secure the first and second brace portions of the cooperating folding braces 93 together. The presence of the second fastener 108 in addition to first fastener 102 allows the folding braces 93 to assume a generally linear alignment so as to impart strength to the table in its erected state. Each locking pin 108 as can be best seen in FIG. 4 is formed having a head 112, a rod 113, and a spring member 114. The spring member passes through a head aperture 115 and has formed adjacent the head 112 a first end 116. This spring member, since it is preferably formed from a wire-like material has a clasp member 117 securing the adjacent wire-like members which make up the locking pin 108. The opposite end of the spring member 114 is formed having a second end 118 which can be flexed to either receive the end of the rod 113, to retain it in a locked position, or flexed, so as to open the locking pin and permit the removal thereof from the cooperating locking pin apertures 109 and 110 respectively.

As FIG. 3 also discloses, the picnic table 10 is formed having a pair of bench frames 120. Each bench frame has an edge channel 122, a side wall 123, a top lip 124, and a bottom lip 125. Preferably the top and bottom lips 124 and 125 extend perpendicularly inwardly from the sidewall 123, with the width of the top lip preferably being greater than that of the bottom lip.

A plurality of seat cross plates 128 also extend perpendicularly across the bench frame 20 from opposite edge channels 122 as shown. Preferably there are at least four such seat cross plates 128 associated with each bench frame 120. These seat cross plates 128 in addition to being parallel to the ends of the bench frame 120, have secured thereto preferably a pair of slotted bars 130. One such pair of slotted bars is secured between each set of the two end most cross plates 128. These slotted bars are preferably welded to the opposing faces of the seat cross plates and extend parallel to the sides of the bench frame 120. Each slotted bar 130 has a slot formed therein 131 of a dimension which enables it to accommodate a slot stud 132. This slot stud 132 passes through the slot in the slotted bar 130 as well as through a seat support aperture 26.

A top cover 135 and a pair of seat covers 136 are secured to the table top frame 30 and the pair of bench frames 120 by fasteners 138. Preferably the top cover 135 and seat cover 136 are formed from UV protected ABS plastic. The remainder of the picnic table 10 is preferably formed from steel or other heavy gauge component parts, although other suitable structural materials such as aluminum or plastic could be used.

Preferably the fixed cross bar 38 has each of its surfaces 1½" wide with the length of the cross bar being 29¼". The apertures formed therein for securing thereto hinge 60 by hinge bolt 65 are preferably ⅜" in diameter and spaced 1½" apart from each pair of apertures associated with each of the hinges along the fixed cross bars. The fixed cross panel 44 is also preferably 29¼" across, and has the cross panel aperture 48 formed having a diameter of 1⅝" with the center of the aperture spaced 14⅝" from the end of the fixed cross panel. The height of the two sidewalls on the fixed cross panel 44 is also 1½". Furthermore, the width of the fixed cross panel is preferably 6".

Each of the center pedestals is approximately 25¾" and 10" wide. Each of the inwardly facing flanges preferably extends 1" from the 1½" wide sidewalls. Each of the seat cross plates 128 are preferably 8¾" across with a 1⅜" recess extending inwardly from each of the sides of the bench frame to enable the seat cross plate to be recessed relative to the top lip 124 of the bench frame, with this recess being ⅛" down from the upper edge of the seat cross plate.

The upright bar preferably is 17⅝" tall and is 1½" square. The base cross bar 16 is preferably 52" long and 1½" square. The seat supports have the arms spaced apart 4⅝". Each of the seat support arms is preferably 3" long with a 13/32" diameter hole being centered 2⅜" in front of the seat support center portion 22 and 11/16" above that portion of the seat support arm which is shown in FIG. 3 to be directly adjacent the seat cover 136. Preferably the height of the seat support as shown in FIG. 3 is 2". Each of the slotted bars is preferably 13⅞" long, 1½" tall with a ½" slot extending a distance of 10⅜". The beginning of the slot is 1 3/16" from the one end of the slotted bar 130. Preferably this bar is ¼" thick.

The second brace portion is preferably formed of galvanized steel sheet such that the distance between the sidewalls 96 is 1½". Each of the sidewalls is approximately 1" in height. The second brace portion 94 has its upper surface being 22 7/16" in length with the upper connecting aperture 100 and the brace connecting aperture 101 both being located ⅜" inwardly from opposing ends of the second brace portion. Additionally, the second brace portion locking pin aperture is formed 4⅜" inwardly from the edge of the second brace portion. As can be appreciated from FIGS. 5 and 6, the end of the second brace portion has a slight chamfer at the end adjacent the second brace portion locking pin aperture.

Figure 6:
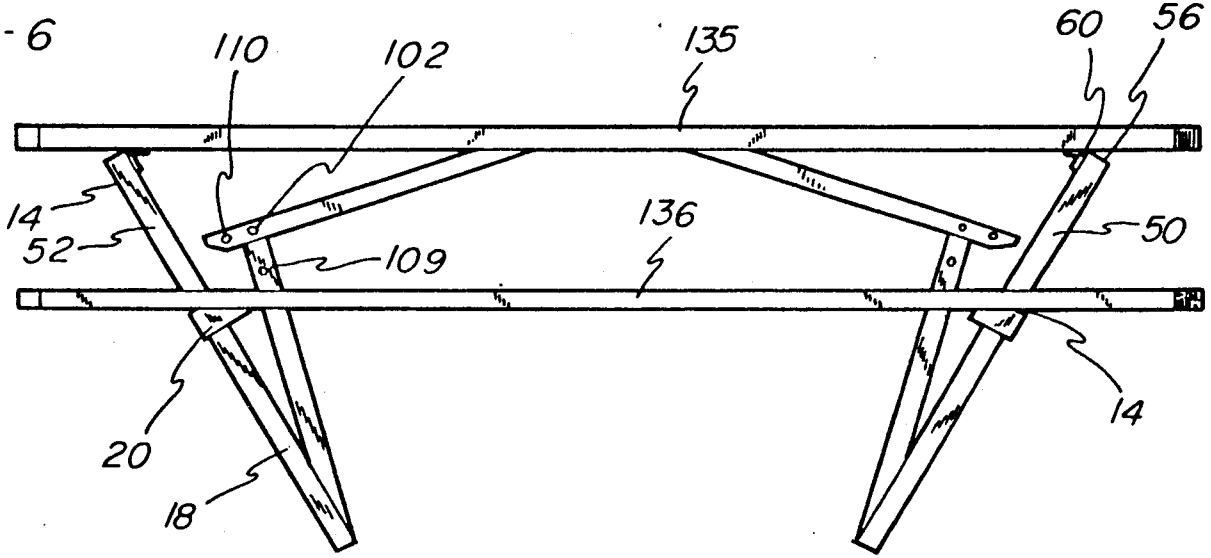
FIG. 6 is a side elevational view of the table partly folded.
Figure 7:
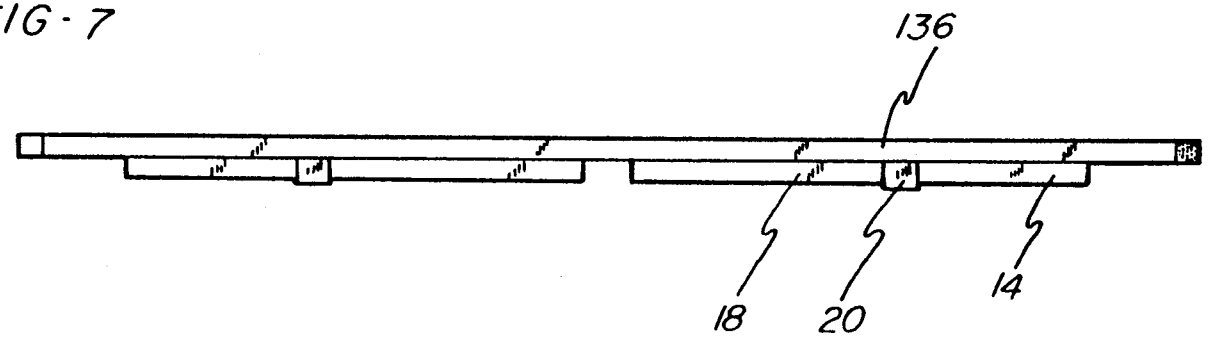
FIG. 7 is a side elevational view of the table completely folded.
Figure 8:
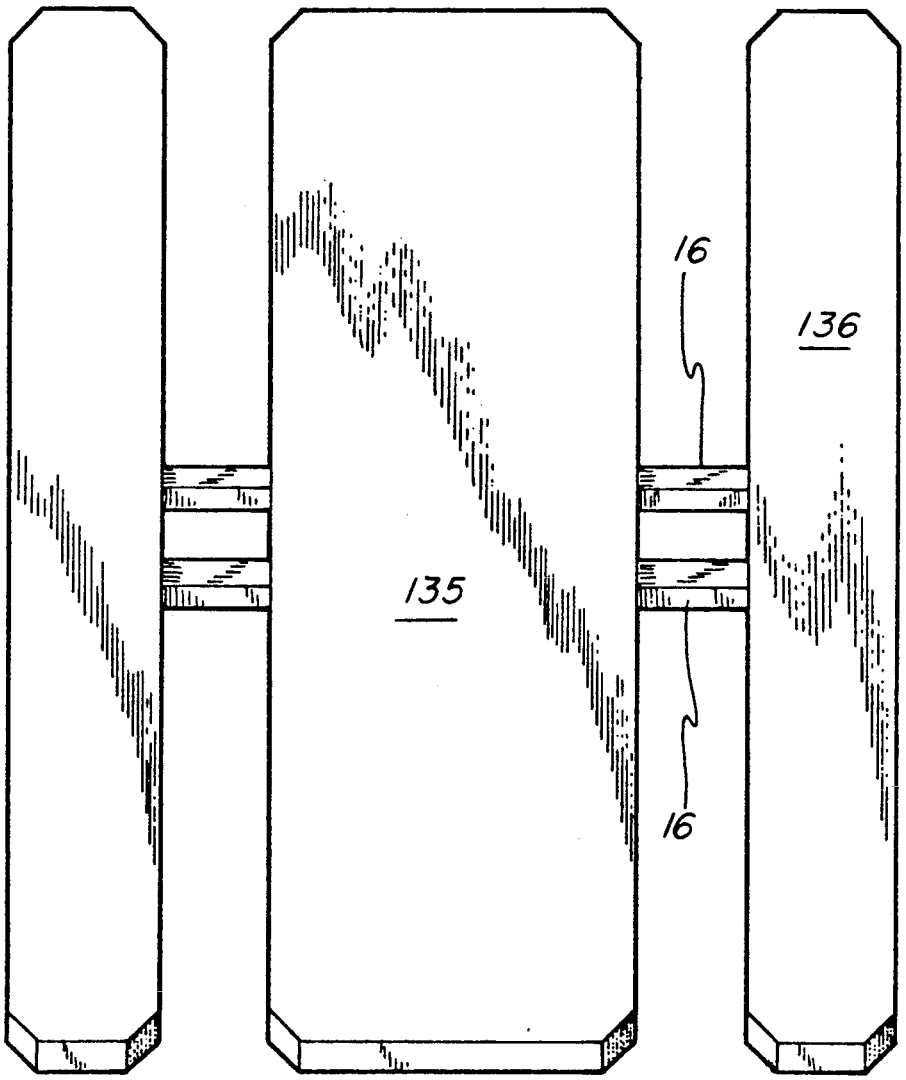
FIG. 8 is a perspective view of the table completely folded.

With respect to the first brace portion 94, it is 19 1/16" long with the sidewalls being 15/16" tall and spaced apart 1 5/16". The end adjacent the brace connecting aperture is chamfered so as to permit the folding of the first brace portion with the respect to the second brace portion. The first brace portion locking pin aperture 109 is formed 4⅜" inwardly from the end of the first brace portion as shown in FIG. 6.

The handle is preferably formed from ⅜" diameter steel bar which has a hand grasping portion approximately 4" in length and extends outwardly from the center pedestal at least 1¼. The various locking tabs are preferably 1" wide, 2" tall, and have a⅜" wide slot extending 1" from top and bottom with the top of the slot being ¼" down from the top of the locking tab. Meanwhile, the locking brackets are preferably formed from 12 gauge steel sheet with the arms being 1" wide and 1⅜" tall. The arms are spaced apart at least 1 9/16" with the 9/32" diameter hole being formed ⅜" below the top of the bracket. The only difference between the dimensions associated with base brackets 72 and upper bracket 88 is the spacing between the respective arms of those brackets. The distance between the respective arms of the upper bracket is 1¾" while the distance between the arms of the base bracket is 1 9/16". With respect to the locking bracket 78 it is preferably formed from 8 gauge steel sheet, is 2½" tall and 1" wide. The locking bracket is adapted to be secured to the sidewalls of the fixed cross panel 44 such that it projects an additional 1" beyond the bottom surface 46. A ⅜" diameter hole is drilled in each of the arms 79, with the center of this hole being approximately 1" above the juncture of the locking bracket with the bottom of the fixed cross panel 44.

Preferably the hinge is 3" wide and 3" tall with each of the holes being ⅜" in diameter and spaced inwardly from each of the sides of the hinge a distance of ¾". The plastic table top is approximately 72" long and 29⅝" wide with each of the corners being chamfered. The distance from the top of the table top to the bottom edge of the table top is approximately 1⅝". Each of the plastic seats is also 72" long but with a width of 9⅛". The distance from the top surface of the seat to the bottom edge of the seat is 1⅝".

Figure 5:
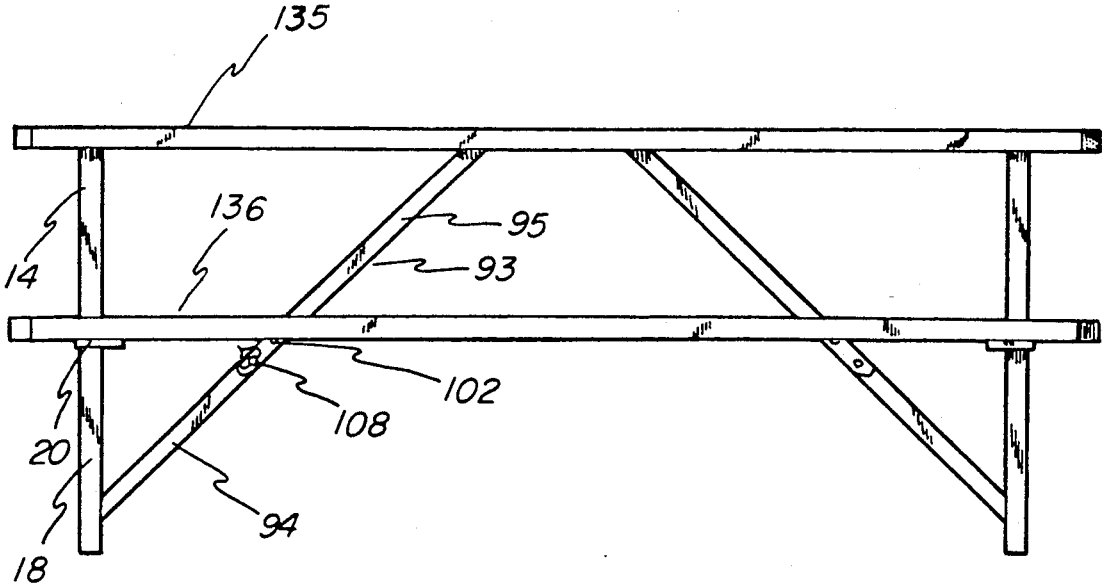
FIG. 5 is a side elevational view showing the folding picnic table in its erected state.

In actual usage, the folding picnic table which is shown erected in FIGS. 1 and 5 may be easily folded, often in less than ten seconds, to a height of less than 4". The folding is accomplished by grasping the spring member 114 of each looking pin and removing the second end 118 from about rod 113, thus facilitating the removal of the locking pin from the cooperating folding braces. Once the locking pins are removed, the center pedestals can be grasped by the handles, and the end frames 12 then pivoted about hinges 60 so that the table resembles that shown in FIG. 6. Preferably this should be done with the table top resting on the ground. As the end frames pivot relative to the table top frame, the slot studs slide within slots 131 as well as causing the seat support to pivot from the position shown in FIG. 3 to a position shown in FIGS. 6 and 7 which end position is essentially perpendicular to that disclosed in FIG. 3. When completely folded the dimensions of the table are approximately 63" by 72".

Once folded, the locking pin in inserted through the apertures in the locking tab and locking bracket to secure the end frame relative to the table top frame when the table is in the folded configuration. This precludes inadvertent unfolding of the table during transport.

It can be appreciated that an improved folding picnic table is provided. The table can be relatively easily fabricated and is extremely easy to use. Additionally, the table is aesthetically pleasing.

To erect the table one need only to remove the locking pin from engagement with the locking tab and locking bracket, grasp the handle, and then pull on the end frame so as to position it as shown in FIG. 3. The locking pin is the reinserted through the cooperating folding braces at the respective locking pin apertures.

In a modified embodiment of the invention, a hole can be cut in the plastic table top directly above the fixed cross panel aperture 48 so as to facilitate the insertion of an umbrella or other shade providing means therethrough.

While the form of apparatus herein described constitutes a preferred embodiment of this invention, it is to be understood that the invention is not limited to this precise form of apparatus and that changes may be made therein without departing from the scope of the invention, which is defined in the appended claims.

What is claimed is:

1. A folding picnic table comprising a pair of spaced end frames each having a center pedestal and a pair of upright bars, said pair of upright bars connected to said respective center pedestal by a base cross bar, a table top frame comprising a fixed cross panel and a plurality of fixed cross bars, each of said center pedestals connected to said table top frame, two pairs of cooperating folding braces, each of said pairs of braces comprising a first brace portion and a second brace portion, each of said first brace portions connected to a respective one of said end frames, said second brace portion connected to said table top frame, said first brace portion and said second brace portion also connected to each other, said first brace portion and said second brace portion connected by a first fastener and also by a second fastener, said second fastener being adapted to be removed from connecting said first and second brace portions such that the removal enables the respective end frames to be pivoted relative to said table top frame so as to effect folding of said table, said first brace portion and said second brace portion being in partially coextensive relationship, and a pair of bench frames, each bench frame comprising at least two slotted bars having a slot formed therethrough, said upright bars connected to said slotted bars.

2. The table according to claim 1 wherein said second brace portions are pivotally connected to said fixed cross panel.

3. The table according to claim 1 wherein said upright bars each comprise a seat support, each of said seat supports being adapted to pivotally engage with at least one slotted bar, said seat supports and said slotted bars maintained in mechanical engagement by slot studs.

4. The table according to claim 3 wherein each of said slotted bars comprises a slot, each of said slots being disposed in a horizontal plane parallel to said bench frames.

5. The table according to claim 1 wherein said table top frame comprises at least one locking bracket, and at least one of said end frames comprises at least one locking tab.

6. The table according to claim 1 wherein said table top frame comprises at least one locking bracket, and at least one of said end frames comprises at least one locking tab, said locking bracket and said locking tab being adapted to be positioned in cooperating relationship, said second fastener after removal from connecting said first and second brace portions being adapted to secure a locking bracket to a locking tab.

7. The table according to claim 1 which includes a handle secured to each of said end frames.

8. The table according to claim 7 wherein said handle is secured to said center pedestal.

9. The table according to claim 1 wherein said center pedestal is hinged directly to said table top frame.

10. The table according to claim 1 wherein said upright bars each comprise a seat support, each of said seat supports comprising a pair of seat support arms, each seat support arm being adapted to pivotally engaged with a slotted bar, said slotted bars each having formed therein a slot, said slots being disposed in a horizontal plane parallel to said bench frames, said seat supports and said slotted bars maintained in mechanical engagement by slot studs.

11. The table according to claim 1 which includes a table top cover and a pair of bench covers.

12. A folding picnic table comprising a pair of spaced end frames each having a handle, a center pedestal and a pair of upright bars, said pair of upright bars connected to said respective center pedestal by a base cross bar, a table top frame comprising a fixed cross panel and a plurality of fixed cross bars, each of said center pedestals connected to said table top frame, said table top frame comprising at least one locking bracket, and at least one end frame comprising at least one locking tab, two pairs of cooperating folding braces, each of said pairs of braces comprising a first brace portion and a second brace portion, each of said first brace portions connected to a respective one of said end frames, said second brace portion pivotally connected to said fixed cross panel, said first brace portion and said second brace portion also connected to each other, said first brace portion and said second brace portion being in partially coextensive relationship, and a pair of bench frames, each bench frame comprising at least two slotted bars having a slot formed therethrough, said upright bars each comprising a seat support, each of said seat supports comprising a pair of seat support arms, each seat support arm being adapted to pivotally engage with a slotted bar, said slotted bars each having formed therein a slot, said slots being disposed in a horizontal plane parallel to said bench frames, said seat supports and said slotted bars maintained in mechanical engagement by slot studs, said first brace portion and said second brace portion connected by a first fastener and also by a second fastener, said second fastener being adapted to be removed from connecting said first and second brace portions, such that the removal enables the respective end frame to be pivoted relative to said table top frame so as to effect folding of said table.

13. The table according to claim 12 wherein said table top frame comprises at least one locking bracket, and at least one of said end frames comprises at least one locking tab, said locking bracket and said locking tab being adapted to be positioned in cooperating relationship, said second fastener after removal from connecting said first and second brace portions being adapted to secure a locking bracket to a locking tab.

14. The table according to claim 12 wherein said center pedestal is hinged directly to said table top frame.

15. The table according to claim 12 which includes a table top cover and a pair of bench covers.

16. A folding picnic table comprising a pair of spaced end frames, each end frame comprising a center pedestal and a pair of upright bars, said pair of upright bars connected to said respective center pedestal by a base cross bar, a table top frame, each of said center pedestals connected to said table top frame, said table top frame having a table top cover secured thereto, two pairs of cooperating folding braces, each of said pairs of braces comprising a first brace portion having a first and a second end and a second brace portion having a first and a second end, means for connecting each of said first brace portions to a respective one of said end frames, means for connecting said second brace portion to said table top frame, means for connecting said first brace portion and said second brace portion to each other, and a pair of bench frames, each of said upright bars having means for pivotally connecting said end frames to said bench frames, said upright bars each comprise a seat support, each of said seat supports comprising a pair of seat support arms, each of said bench frames comprising two pairs of slotted bars, each of said slotted bars having a slot formed therein, said slots being disposed in a horizontal plane parallel to said bench frames, each seat support being adapted to pivot and slide within said slots each of said bench frames having a seat cover secured thereto.

17. A folding picnic table comprising a pair of spaced end frames, each end frame comprising a center pedestal and a pair of upright bars, said pair of upright bars connected to said respective center pedestal by a base cross bar, a table top frame, each of said center pedestals connected to said table top frame, said table top frame having a table top cover secured thereto, two pairs of cooperating folding braces, each of said pairs of braces comprising a first brace portion having a first and a second end and a second brace portion having a first and a second end, means for connecting said first brace portion to said end frame, means for connecting said second brace portion to said table top frame, means for connecting said first brace portion and said second brace portion to each other, said first brace portion and said second brace portion are connected by a first fastener and also by a second fastener, said second fastener being adapted to be removed from connecting said first and second brace portions such that the removal enables the respective end frame to be pivoted relative to said table top frame so as to effect folding of said table and a pair of bench frames, each of said upright bars having means for pivotally connecting said end frames to said bench frames, each of said bench frames having a seat cover secured thereto.

18. The table according to claim 17 wherein said table top frame comprises at least one locking bracket, and each of said end frames comprises a handle and at least one locking tab, said locking bracket and said locking tab being adapted to be positioned in cooperating relationship, said second fastener after removal from connecting said first and second brace portions being adapted to secure a locking bracket to a locking tab.

* * * * *